US005803826A

United States Patent [19]

Perrine

[11] Patent Number: 5,803,826

[45] Date of Patent: Sep. 8, 1998

[54] USER-FRIENDLY GOLF SWING PRACTICE MAT

[76] Inventor: James J. Perrine, 5330 N. Via Celeste, Tucson, Ariz. 85718

[21] Appl. No.: 689,241

[22] Filed: Aug. 6, 1996

Related U.S. Application Data

[63] Continuation of Ser. No. 448,296, Feb. 28, 1995, abandoned.

[51] Int. Cl.[6] ..... A63B 69/36

[52] U.S. Cl. ..... 473/278; 473/257

[58] Field of Search ..... 473/278, 279, 473/150, 257, 262

[56] References Cited

U.S. PATENT DOCUMENTS

| | | | |
|---|---|---|---|
| 3,348,847 | 10/1967 | Fischl | 273/186 |
| 3,717,349 | 2/1973 | Bohnen | 273/186 R |
| 3,880,432 | 4/1975 | Coffey et al. | 273/195 A |
| 4,023,810 | 5/1977 | Lorang | 273/187.1 |
| 4,889,342 | 12/1989 | Hugunin | 273/195 R |
| 4,955,611 | 9/1990 | Moller | 273/195 A |
| 5,028,052 | 7/1991 | Miller | 273/195 R |
| 5,273,285 | 12/1993 | Long | 273/195 A |
| 5,306,011 | 4/1994 | Perry | 273/187 A |
| 5,333,875 | 8/1994 | Wilson | 273/187.1 |
| 5,354,064 | 10/1994 | Toikka | 273/195 A |

*Primary Examiner*—Jessica Harrison
*Attorney, Agent, or Firm*—Benman & Collins

[57] ABSTRACT

A user-friendly golf swing practice mat is provided, comprising: (a) a low friction, compliant and resilient top sheet having a rigidity of less than 40 pounds per square inch; and (b) a bottom pad (natural grass or an accompanying compliant, resilient pad) for supporting the top sheet a finite distance above the underlying base, for providing space for the top sheet to yield to and accommodate the bottom-most portion of a reasonably well-aligned golf club swing-arc. The golf swing practice mat avoids the mechanical limitations and problems associated with prior art mats. In typical usage, the respective properties of the top sheet and the bottom pad together enable the whole mat to function so that—like a natural-grass-covered fairway—it imposes very little resistance as it readily yields to and accommodates the bottom-most portion—between the bottom of the ball and the underlying ground/base—of any fill, and reasonably well aligned golf club swing arc. Golf clubs that are swung through arcs which hit down before one's stance and rotation center, and would otherwise tend to dig into a natural earth base, or a typical practice-range mat, impact relatively softly and slide forward without appreciable loss of momentum, and allow the golfer to complete the somewhat mis-aligned swing-arc without discomfort and deterrence to future efforts.

12 Claims, 4 Drawing Sheets

USER-FRIENDLY GOLF SWING PRACTICE MAT

This is a continuation of application Ser. No. 08/488,296 filed on Feb. 28, 1995 now abandoned.

FIELD OF THE INVENTION

The present invention is directed to golf accessories, and more particularly, to practice mats used to help a golfer improve his or her swing.

BACKGROUND AND OBJECTS OF THE INVENTION

To develop and maintain a really good golf swing ability, individuals must go through an extensive, two-part process:

(1) they must learn about various technique basics like preparatory grip positioning and pressure, stance width, posture and alignment, the best ball positions for various clubs, and finally, back swing and forward swing motions, rhythms and tempos; and (2) they must engage in many practice sessions to experience and learn, through trial and error, how to correctly execute the various technique basics, see how each one contributes to a good end result, and finally how they all work together; thereafter they must practice regularly to keep everything familiar.

The general object of the present invention is to provide a golf swing practice mat that actually facilitates the golf swing learning/practicing process, and overcomes some basic limitations and problems of learning/practicing on either natural-grass-covered earth, or typical practice-range mats, e.g., neither of which provide any helpful body or swing alignment guidelines, and both can be unforgiving of the very common, somewhat mis-aligned swings that extend a little too low and/or hit the ground a little back of one's stance center. Even small errors can cause a sharp jolt to be transmitted back to the golfer, and/or the smooth forward motion of the club to be disrupted by resulting resistance, either of which can be quite uncomfortable to the hands, can wrench other parts of one's body, and can even cause an acute or cumulative, chronic injury.

Golfers swing their clubs through an arc, the plane of which is inclined to the ground. To hit shots well, it is crucial that the swing-arc, as executed, is aligned so that:

(a) in the vertical plane, it extends down at least to—and preferably a little below—the level of the bottom of the ball, at impact with the ball; thus, even when one's ball rests in some healthy fairway grass, one's club head must necessarily be quite close to hitting the underlying ground also—at impact with the ball;

(b) in the horizontal plane, it is both tangent to the intended flight line of the ball, and it bottoms out ahead of one's stance center, which, depending on the club used, will be either just past, at, or before the ball's position.

When a club is swung through a well-aligned swing-arc, at a ball resting in some natural, regularly mowed, fairway grass, no uncomfortable impact shock is produced by either the ball or the grass, and very little resistance is encountered to any attendant downward and/or forward club head movement through it. The negligible amount of resistance imposed by mowed, natural grass itself, as distinct from the feel of the inertial resistance of a ball, can be quickly confirmed by making one well-aligned practice swing through it, absent a ball. Natural grass is so flexible, and has such a low tensile strength, that it flattens readily, and even tears away upon contact with a club head. Even if a club head then strikes the underlying earth after impacting a ball, thus favorably ahead of the golfer's stance and rotation center, its own kinetic energy will normally overcome this subsequent resistance, and the golfer will hardly feel the contact, nor experience any appreciable disruption of forward momentum. In fact, the totally effortless feel of a well-aligned swing on a fairway can be quite surprising.

However in anticipation of experiencing some adverse consequence from making yet another mis-aligned swing, even when the ball is sitting in the middle of a fairway, many struggling golfers make one or both of the following mistakes:

(a) to keep any contact with the underlying ground prior to reaching the ball from disturbing their club's position in their hands, and thus the squareness of its head to the ball, they tend to grip their clubs wrong and/or too tightly; however, this action unavoidably also stiffens their wrists, which prevents them from properly hinging freely during a swing;

(b) to hopefully improve their chances of hitting a ball without hitting some underlying ground or a teeing mat, they try to "steer" their club head through the hitting area.

Unfortunately, either of these defensive tendencies inevitably relegate practitioners to the legions of ball-oriented hand or arm swingers, and persistently prevent them from learning how to swing a golf club fully and fluidly—with good rhythm and acceleration—around a central, whole-body axis, so that the greater speed and kinetic energy developed in the club's head drives the ball forward more effectively, and with less strain.

More-proficient golfers usually have learned the folly of trying to swing a golf club so as to avoid some envisioned adverse consequence, but still have trouble at times with aligning their swing-arcs optimally in both the vertical and horizontal planes.

Accordingly, it is a primary object of this invention to provide a more "user-friendly" mat for basic golf swing learning and practice that (1) like typical golf course fairways, imposes only a negligible amount of resistance on downward and forward club head movement during well-aligned swings; (2) does not inflict immediate punishments on golfers—specifically forward motion disruptions or unpleasant impact shocks against either the mat itself or the underlying ground—for making somewhat mis-aligned swings; and thereby (3) encourages golfers to unflinchingly try, regularly practice, and indelibly learn how to grip clubs properly, and execute full, fluid swings that extend down to the requisite depth.

Heretofore, many prior-art golf teeing mats have had a top layer of upright or woven fibers. Since the object of the present invention is to provide a practice mat to help golfers develop the ability to swing a golf club fully and fluidly, through a wellaligned swing-arc, not to serve as a more durable substitute for natural grass-covered teeing areas, there is no need for a top layer of material that visually resembles natural grass. Moreover, although a pad of such material might have a soft enough top surface to avoid an immediate, uncomfortable, impact shock, it inherently can not provide as low a dynamic resistance to normal amounts of downward and forward club head movement through it as mowed, and self-restoring natural grass, since its fibers must quickly, resiliently bounce back if compressed or flattened, and must not easily tear away. Although it is not impossible to execute full, fluid, well-aligned swings on typical artificial turf mats, their characteristics make it especially difficult for one to learn how to accomplish them appropriately and consistently.

The significant amount of resistance imposed on a moving golf club head by artificial turf mats was addressed by at least some earlier inventors, including Long, U.S. Pat. No. 5,273,285, Dec. 28, 1993, who sought to limit artificial turf friction by providing a relatively stiff backing sheet to ensure that the width of a "trough" created by a club in a cushioned, artificial-turf-covered mat is never less than 20 cm (8 inches). Of course, this provision would not reduce friction below that which occurs in uncushioned, artificial-turf-covered mats, where little or no such trough is formed.

Moller, U.S. Pat. No. 4,955,611, Sep. 11, 1990, tried to overcome artificial turf resistance by devising means to allow a sizable section of a cushioned artificial turf mat to move forward upon contact by a club head. Even with this provision however, it is unlikely that the inertial mass of an entire movable section of an artificial turf mat would in fact present as low a dynamic resistance to a moving club head as simply a number of blades of mowed, natural grass.

It should be noted that some artificial turf mats might be useful for practicing the specialized technique sometimes needed for shots out of deeper, unmowed "rough" grass, wherein the golfer may not be able to rely on the kinetic energy of the club head to fully overcome the elevated resistance, and may in fact have to add some muscle force to keep any excess resistance from dropping the club head's speed before impact, which in turn would reduce the distance the ball travels. However for learning/practicing an optimum, basic swing technique, which is the focus of the present invention, current artificial turf mats are not suitable—in part because they tend to make one try to "muscle" the club to get it fully down behind a ball and then through the short zone of abnormally elevated resistance, and/or to grip too tightly.

Thus, a need remains for a golf swing practice mat that overcomes the foregoing mechanical limitations and problems of both natural and artificial grass-covered practice facilities.

Another object of the present invention is to provide a practice mat that will visually guide golfers as they work to master basic golf-swing techniques which promote the execution of swing-arcs that not only extend to the requisite depth, but also are tangent to the intended flight line, are favorably oriented to a ball's position relative to their stance center, and bottom out ahead of their stance center.

Yet another object of this invention is to provide a practice mat that will give helpful feedback to golfers on how well they are accomplishing the previously-described, aligned-swing-arc end-results, i.e., to show them what aspect(s) of their executed swing-arc alignment, if any, they will need to adjust through technique improvements.

Still another object of this invention is to provide a practice mat for accomplishing the preceding basic swing learning/practicing objects—both without and with an actual golf ball in place to hit, to show golfers whether and how their executed swing-arc alignment may be changing for actual ball strikes, versus preparatory practice swings.

A still further object of this invention is to provide a single golf swing practice mat that can be used with either irons or woods, is simple and relatively inexpensive to manufacture, and is light and portable, so it can be used directly on various available surfaces, e.g. golf practice ranges offering either natural grass or range mats, one's own back yard—without damaging the lawn grass, or inside one's house on a carpet or floor—without damaging either.

SUMMARY OF THE INVENTION

In accordance with the present invention, a user-friendly golf swing practice mat is provided, comprising:

(a) a low friction, compliant and resilient top sheet having a rigidity of less that 40 pounds per square inch; and (b) a means for supporting the top sheet a finite distance above an underlying base, for providing space for the top sheet to yield to and accommodate the bottom-most portion of a reasonably well-aligned gold club swing-arc.

Like typical golf course fairways, the mat of the present invention imposes only a negligible amount of resistance on downward and forward club head movement during well-aligned swings. Unlike typical golf course fairways or prior art teeing mats, however, it does not inflict immediate punishments on golfers for somewhat misaligned swings, and is overall more user-friendly than either.

In a preferred embodiment, the top sheet of the golf swing practice mat includes markings and guidelines thereon to help users achieve proper body and swingarc alignments. The markings include at least one of the following:

(a) the intended flight line/track of a ball;

(b) the proper placement—front to back in the horizontal plane—of the user's stance center at address;

(c) specific ball positions—front to back in the horizontal plane; and (d) specific, incremental stance widths.

In another preferred embodiment, the top sheet of the golf swing practice mat is made from a semi- to fully-transparent material so that helpful markings and guidelines placed on its underside show through to a user.

In yet another preferred embodiment, the top sheet has shallow dimples formed in its top surface to facilitate the placement of a golf ball to be hit therefrom by a golfer, with a practice swing.

In still a further preferred embodiment, the top surface of the top sheet is suited to the application of a visible substance, such as common household spray wax or a soap solution, that registers the path of a golf club head passing through the actual or represented hitting area when the club head is in contact with the mat near the bottom-most point in its swing-arc. Such registration provides helpful practice swing feedback to the golfer.

These and other objects and advantages of the invention will become apparent in the following detailed description and drawings of the invention.

DETAILED DESCRIPTION OF THE PREFERRED EMBODIMENTS

Reference is now made in detail to a specific embodiment of the present invention, which illustrates the best mode presently contemplated for practicing the invention. Alternative embodiments are also briefly described as applicable.

Figure 1:
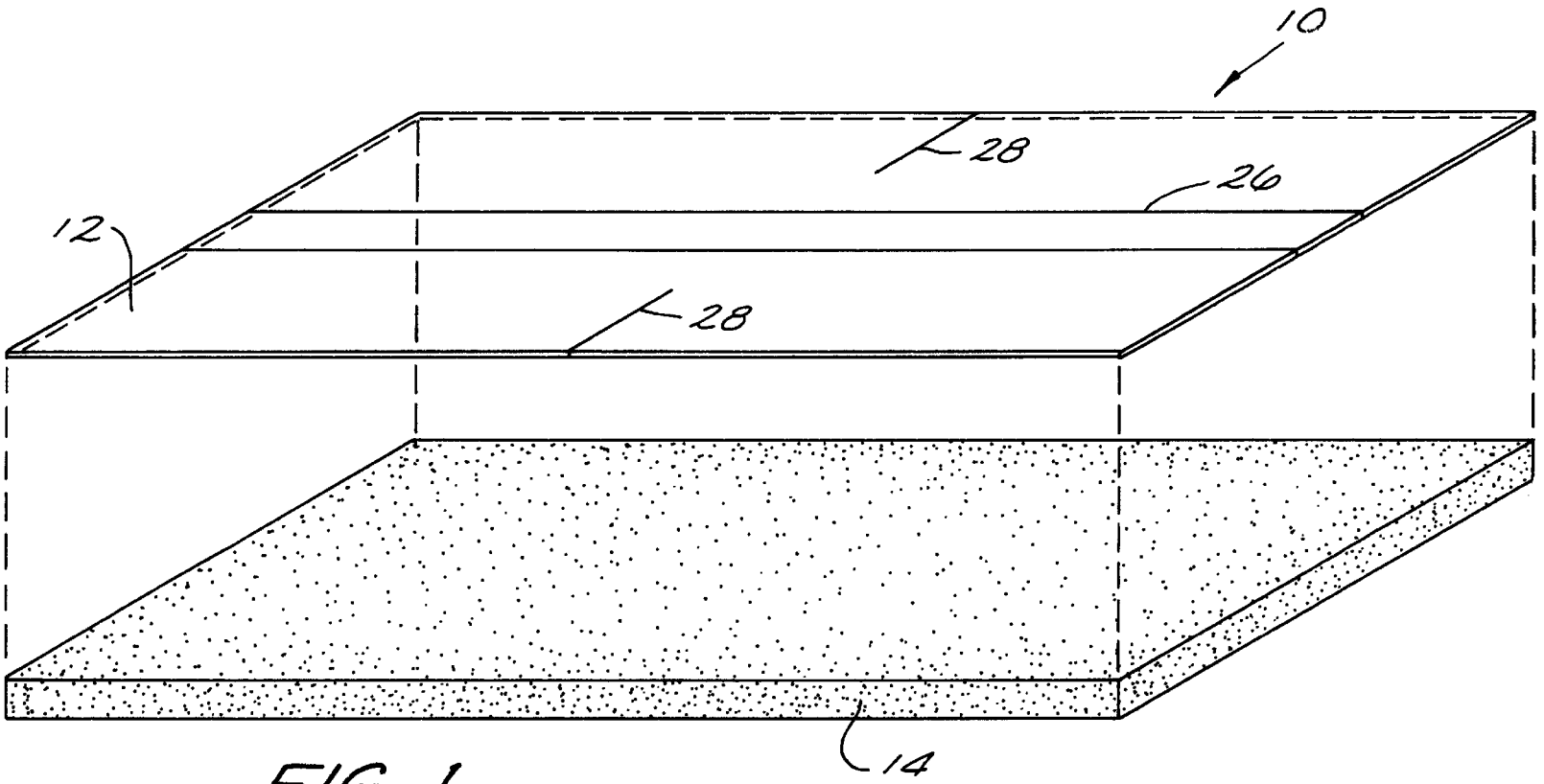
FIG. 1 is an exploded, perspective view of my golf swing practice mat invention.

FIG. 1 depicts, in exploded view, the mat 10 of the present invention. The mat 10 is comprised of just two structural elements: a top sheet 12 and a bottom pad 14.

The top sheet 12 has a completely smooth, and very low-friction surface, is resilient and tends to lie flat at rest, yet is relatively compliant/non-rigid. It is made of a suitable type, size and thickness of sheet material such as plastic. As an example, Dupont's Surlyn 8940 has a flexural modulus at 23° C. (73° F.) of 350 Mpa (51,000 psi) (ASTM D-790) according to the manufacturer, and in a 76 cm (30 inches) long, 30 cm (12 inches) wide, 0.16 cm (0.062 inch) thick sheet, gives a sheet rigidity (flexural modulus, times thickness cubed, times width, divided by 524—for S.I. units, or 12—for English units) of only about 0.082 MPa (12 psi), which works very well. A top sheet of this size and made from this material is also extremely tough and resilient; and does not develop excessive plastic (permanent) deformations under repeated blows from a golf club, even at an ambient temperature of 38° C. (100° F.), nor does it feel uncomfortably hard at 4° C. (40° F.). However, the same size sheet of Surlyn 8940, but in a 0.24 cm (0.093 in) thickness, giving a rigidity at 23° C. (73° F.) of about 0.283 MPa (41 psi), does feel a little hard and obstructive when struck with a golf club, indicating that this amount of rigidity exceeds, at least slightly, the practical upper limit for meeting the comfort and function objects of this invention. Therefore, the rigidity of the top sheet 12 of this invention is below 0.276 MPa (40 psi), and preferably below about 0.207 MPa (30 psi).

In another embodiment, the top sheet 12 is made from equally tough and resilient polyurethane, which is available in a wide range of flexural moduli from a variety of manufacturers. As an example, Goodrich's Estane 58277 has a flexural modulus of 63 MPa (9150 psi), and in a sheet the same size as the preceding Surlyn embodiments, but with a 0.254 cm (0.100 in) thickness, giving a rigidity of about 0.062 MPa (9 psi), also works well. In fact, the lower the rigidity of the top sheet 12, the closer it approaches the compliance of natural grass.

In yet another embodiment, the top sheet 12 is made of a same size sheet of Estane 58277, but in a 0.147 cm (0.058 in) thickness, giving a rigidity of only about 0.012 MPa (1.8 psi). Even a top sheet 12 this compliant works well when used at some practice sites, as described below.

To work well, the top sheet 12 of this invention must perform three main, mechanical functions:

(a) it must provide a generally flat surface on which a golfer can visualize, or place a golf ball to be hit therefrom with a practice swing of a golf club;

(b) it must act as a sufficiently compliant, low friction barrier which does not produce an immediate, uncomfortable impact shock, and permits a golfer to easily extend the head of a golf club to a depth that is somewhat below the level of the bottom of a ball, and which also prevents the head of a golf club from digging into any higher friction, underlying surface at any point during a practice swing, which could appreciably disrupt the club's primary forward momentum;

(c) if the underlying ground/base at the site where the mat 10 is used is hard enough to transmit a subsequent, uncomfortable impact shock to a golfer if struck by a golf club during a practice swing, the top sheet 12 must have just enough rigidity so that it acts to decelerate the weaker downward impulse of a club head enough to appreciably soften any such impacts.

Both the first Surlyn embodiment and the first Estane embodiment of the top sheet 12, as described above, do satisfy each of the three preceding mechanical criteria when used at virtually any practice site. The second Estane embodiment of the top sheet 12 described above, has insufficient ridigity to meet the third mechanical criterion at all sites. Thus, its use is somewhat limited, but works well at sites where the underlying ground/base is relatively soft, e.g., on natural grass-covered practice areas which have a high sand content in the underlying earth, or indoors on a carpet which is relatively "plush", and/or is itself resting on a cushioning under-pad.

No doubt suitable grades, thicknesses, and sizes of other low friction materials which could also provide for sheet rigidities below 0.276 MPa (40 psi), and are tough and resilient, would also work for the top sheet 12 of this invention.

Problems of delamination, stretching, wrinkling and club head snagging that can occur with prior-art mats having an insufficiently bonded top layer of higher-friction material like artificial turf are avoided with the mat 10 of the present invention.

The bottom pad 14 is also resilient and very compliant. The bottom pad 14 can be the natural grass already covering the ground of a practice-range hitting area, or, to permit the top sheet 12 to be used on inadequately thick and compliant bases like typical range mats, some home carpets or floors, etc., the bottom pad can be a same size, accompanying pad having a thickness at least that of natural fairway grass, which is typically mowed to a height of 0.95 to 1.7 cm (0.375 to 0.675 in), and made from a relatively soft type of foam rubber, woven fabric, etc. The amount of compressive resistance the bottom pad 14 contributes to the mat 10 is not critical so long as it does not nullify the user-friendly, sub-40 psi compliance of the top sheet 12. For example, if an embodiment of the top sheet 12 has a near-upper limit rigidity of 0.269 MPa (39 psi), then the accompanying bottom pad 14 can not add a compressive resistance greater than 0.007 MPa (1 psi). However, if the top sheet 12 has a rigidity of either 0.082 MPa (12 psi) or 0.062 MPa (9 psi), as do the preceding first Surlyn and Estane embodiments, then the accompanying bottom pad 14 could add a compressive resistance of either 0.193 MPa (28 psi) or 0.217 Mpa (31 psi), respectively. With any preferred sub-30 psi embodiment of the top sheet 12, then a bottom pad 14 made of, for example, either a low or medium density urethane foam, which can be compressed to 50% of its resting height by an applied pressure between about 0.007 MPa (1 psi) and 0.028 MPa (4 psi), works well.

The bottom pad 14 primarily serves to support the top sheet 12, and a ball 16 (not shown in FIG. 1, but seen in FIG. 2) lying thereupon, at least a little distance above the ground or other base, so that the top sheet has room to yield easily, and allow the user's swing-arc to extend, when desired, down to a depth safely below the level of the bottom of the ball, but still above the ground/base 17. The bottom pad 14 also contributes somewhat to the decelerating, soft cushioning effect on any impacts of the user's club with the underlying ground/base 17.

In typical usage, the respective properties of the top sheet 12 and the bottom pad 14 together enable the whole mat 10 to function so that—like a natural-grass-covered fairway—it imposes very little resistance as it readily yields, and accommodates the bottom-most portion—between the bottom of the ball 16 and the underlying ground/base 17—of any full, and reasonably well-aligned golf club swing-arc 18. And, golf clubs that are swung through arcs which hit down before one's stance and rotation center, and would otherwise tend to dig into a natural earth base, or a typical practice-range mat, impact relatively softly and slide forward without appreciable loss of momentum, and allow the golfer to complete the somewhat mis-aligned swing-arc without discomfort, and deterrence to future efforts.

Figure 2:
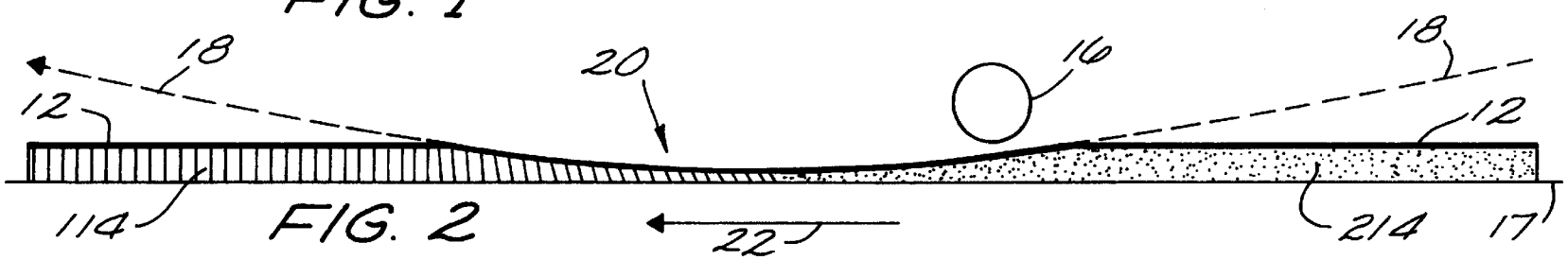
FIG. 2 is a side view of the mat of FIG. 1 as it accommodates a good golf club swing-arc.

FIG. 2 depicts the top sheet 12 resting either on natural grass 114 or on an accompanying bottom pad 214. The top sheet 12 is seen to deform in the region 20 as it accommodates a good golf club swing arc 18 executed to hit a golf ball 16 in the position indicated. The direction of travel of the golf club head (not shown) is indicated by arrow 22.

Figure 3:
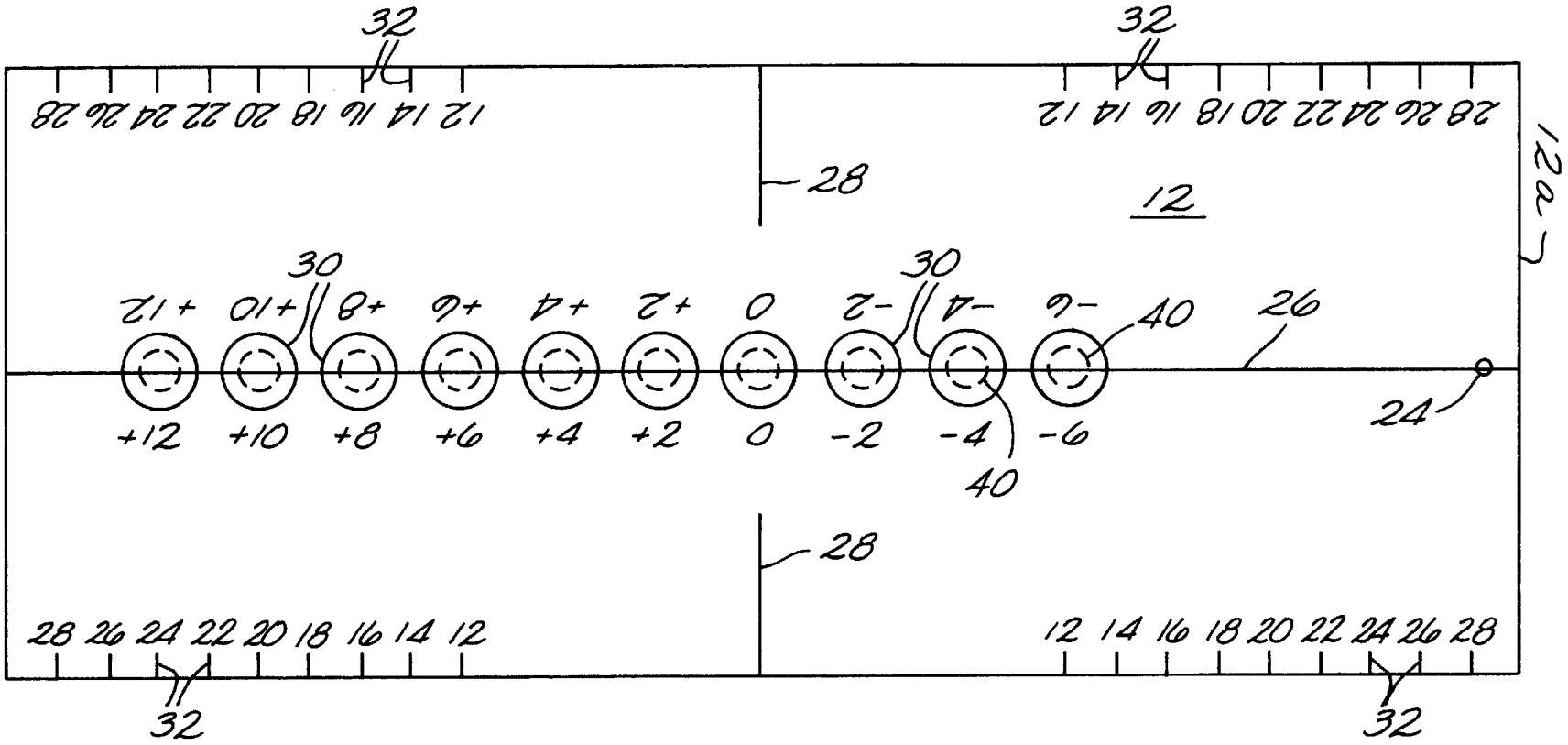
FIG. 3 is a top, plan view of a first embodiment of my invention, showing the markings visible on the mat of FIG. 1.

Turning now to FIG. 3, a hole 24 in the top sheet 12 centered near its back edge 12*a* will accommodate a nail or equivalent to be placed through it into natural earth, to anchor the mat when it is used on natural grass-covered-earth practice areas.

The accompanying bottom pad 14 has relatively high-friction surfaces, which serve to anchor the mat when it is used on top of range mats, home carpets or floors, etc.

A screw (not shown) placed through the back hole 24 in the top sheet 12, and through a corresponding hole in the accompanying pad 14, and held in place by a wing nut (not shown), prevents slippage between the two. The top sheet 12 and accompanying bottom pad 14 also can be thermally or adhesively bonded to produce a somewhat more expensive version of the mat 10, which, however, is more convenient.

The combination of a compliant top sheet 12 and an accompanying bottom pad 14 will protect most all practice surfaces from damage by golf clubs swung in a reasonably normal manner. When used on top of natural-grass-covered practice areas, the combination is even more forgiving of a user's swing-arc depth errors than the top sheet 12 alone.

Figure 4:
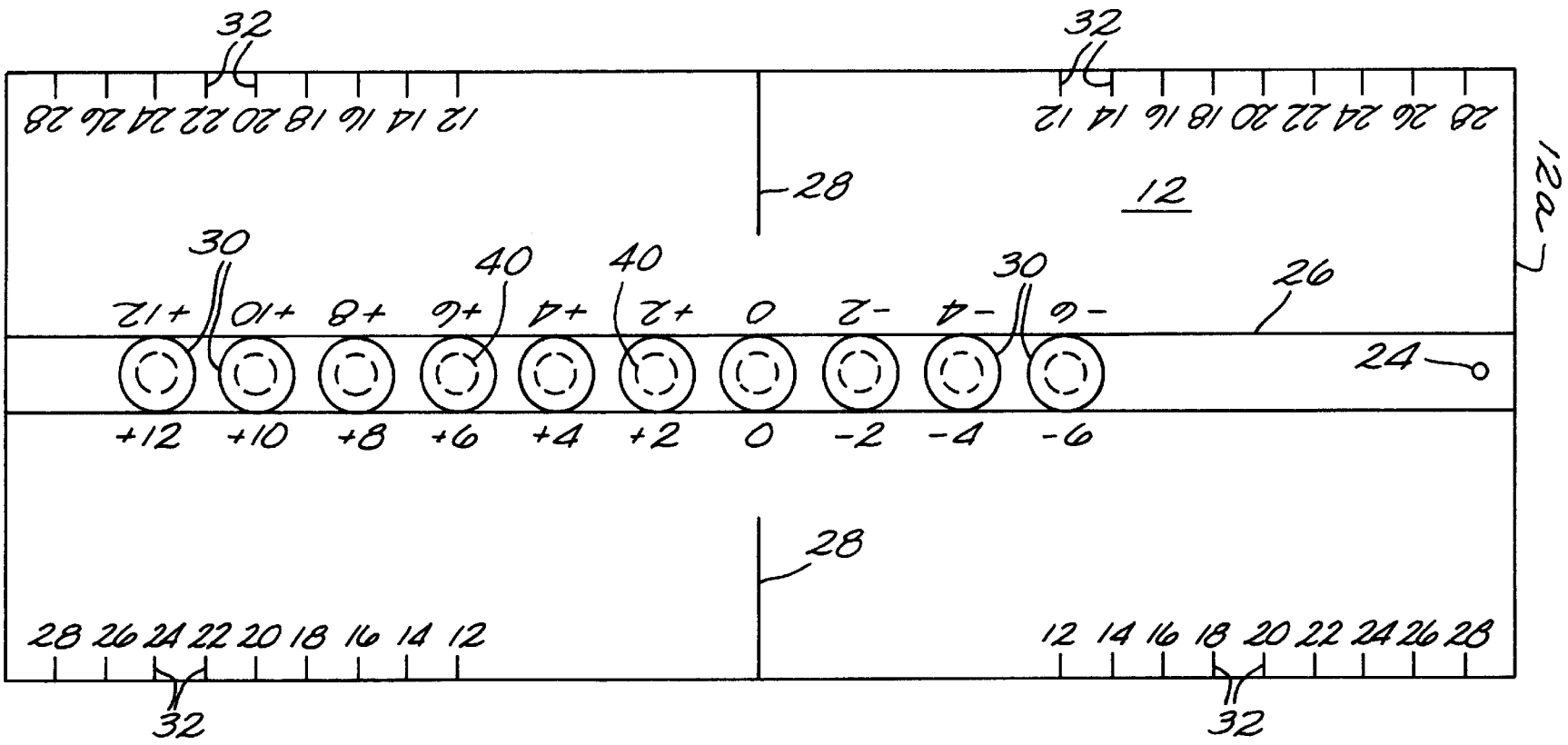
FIG. 4 is a top, plan view of a second embodiment of the markings visible on the mat of FIG. 1.

Markings and guidelines are placed on the top sheet 12 to help users achieve proper body and swing-arc alignments. The markings include meaningful representations and indicators (such as those shown in FIGS. 3 and 4) of any or all of the following: the intended flight line/track 26 of a ball, the proper placement—front to back in the horizontal plane—of the user's stance center at address 28, specific ball positions 30—also front to back in the horizontal plane, and specific, incremental stance widths 32.

The top sheet 12 may be made from a semi- to fully-transparent type of plastic so that the preceding markings and guidelines, etc. placed on its underside, or some other surface underneath the top sheet, will show through to the user, but not be rubbed off from repeated contacts by a golf club.

The preceding markings and guidelines are placed bilaterally on or under the top sheet 12, so that golfers with either right or left-handed swings can be guided by them when they use the mat 10.

Figure 5:
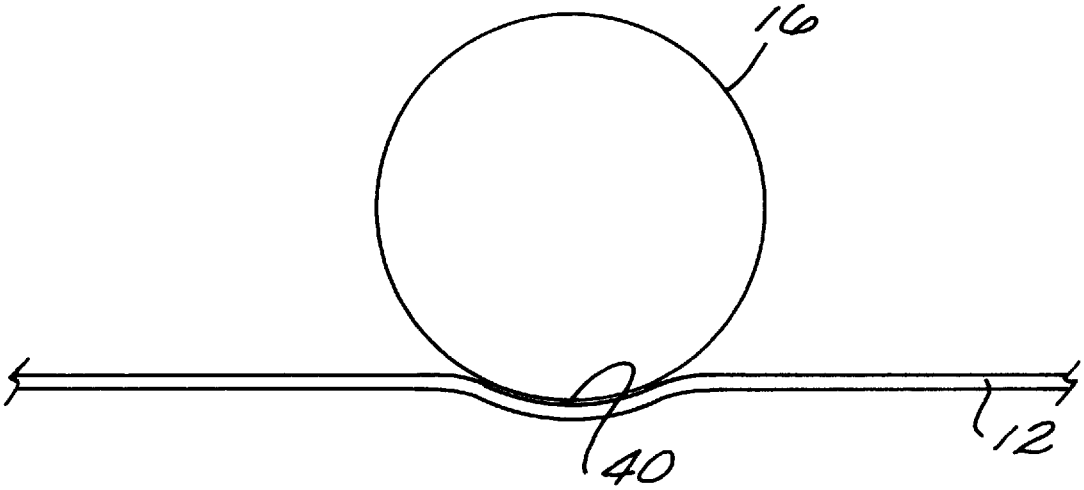
FIG. 5 is a side elevational view, in detail, of one of the shallow dimples formed in the mat of FIG. 1, with a golf ball resting therein.

As shown in FIG. 5, shallow dimples 40, pressure- or thermo-formed in the top sheet 12, facilitate the placing of a golf ball 16 at one or more locations on the top sheet 12, e.g., at the center of each of the indicated ball positions 30.

A conventional rubber tee with a base flange (not shown) as typically used with range mats can be placed on top of the mat 10 for practicing teed-up shots.

The above rubber tee can be tethered to the mat 10 by means of a cord (not shown) attached to both the tee and a hole in the mat (not shown), to ensure that the tee does not become lost during use.

Any one of the indicated ball positions 30 on the mat 10 can be observed by itself, without an actual ball in place to hit, for very useful, basic, aligned-swing-arc practice.

Unlike natural grass or artificial-turf-covered teeing mats, the top sheet 12 of mat 10 of the present invention provides a gentle, but distinct, audible and tactile feedback to users as to whether, and to some degree by how much their swing-arcs 18 have extended down to somewhat below the level of the top sheet, and thus the bottom of a ball. However unlike the No. 10, turfless teeing mat described in the aforementioned Patent to Long, which specifies using a considerably more rigid combination of size, thickness and material type for its top sheet, e.g., a 81 cm (32 inches) long, 17 cm (6.75 inches) wide, 0.20 cm (0.080 inch) thick sheet of polycarbonate, which has a 2379 MPa (345,000 psi) flexural modulus, and gives a sheet rigidity of about 0.689 MPa (100 psi), vs the rigidity of about 0.082 MPa (12 psi) for the even wider sheet of Surlyn 8940 preferred for the present invention, no sharp and unpleasant impact shocks are produced by the top sheet of the present invention. A mat whose top sheet rigidity exceeds 0.276 MPa (40 psi), regardless of the softness of a cushion underneath, would surely incline many users to either grip too tightly, or to tend to steer their club head so that it does not smack against the hard top surface of the mat, and thus not extend down fully to, or a little below the bottom of the ball, as is desirable.

The combination of the smoothness, resting flatness, and compliance of the top sheet 12 employed in the present invention also permits a visible substance like a common, household spray-wax, or foamy soap solution, to be applied to it—to temporarily register the actual path of a golf club's head passing through the hitting area, when the club head is in contact with the top sheet near (both somewhat before and beyond) the bottom point of a given, practice swing-arc 18.

The smoothness of the top sheet 12 also permits a golfer or an instructor to place additional, temporary markings on it, with an ordinary, erasable marking pen, to further guide the golfer. For example, the approximate, normal amount of sideways curvature in the swing-arc of a given golf club—in relation to the straight flight line/track 26 of a ball—may be drawn on the mat 10 for learning purposes.

I believe that the principal provisions of my golf swing practice mat 10 are:

(a) the combination of a relatively low amount of friction and a suitable degree of compliance that is provided by the mat, which enables it to accommodate wellaligned swing-arcs as readily as typical golf course fairways, and also accept somewhat mis-aligned swing-arcs without imposing immediate motion or comfort penalties;

(b) the particular visual guidelines for body and swing-arc alignment that are provided by the mat; and (c) the feedback provided on how well one's swing-arc has met the various alignment criteria during a practice swing—both from the audible and tactile indications, and from the visible track left in an applied substance as the mat yields to the golf club near the bottom of its particular swing-arc.

Thus, there has been disclosed a more user-friendly golf swing practice mat. It will be readily apparent to those skilled in this art that various changes and modifications of an obvious nature may be made, and all such changes and modifications are considered to fall within the scope of the invention, as defined by the appended claims.

What is claimed is:

1. A golf swing practice mat for placement on an underlying base to aid a golfer in improving his or her swing of a golf club having a club head, said swing comprising a swing-arc having a bottom-most portion thereof, said golf swing practice mat comprising:

(a) a low friction, flexible and resilient top sheet that is directly contacted by said club head during said swing and has a rigidity of 40 pounds per square inch or less; and (b) a means for supporting said top sheet a finite distance above said underlying base and for providing space for said top sheet to yield to and accommodate said bottom-most portion of a reasonably well-aligned golf club swing-arc, such that said mat has a aggregate, total rigidity of 40 pounds per square inch or less.

2. The golf swing practice mat of claim 1, wherein said means comprises natural grass covering a ground base.

3. The golf swing practice mat of claim 1, wherein said means comprises an accompanying, compliant, resilient pad.

4. The golf swing practice mat of claim 3, wherein said top sheet is thermally or adhesively bonded to said accompanying pad.

5. The golf swing practice mat of claim 1, wherein said top sheet includes at least one of the following markings thereon:

(a) the intended flight line/track of a ball;

(b) the proper placement—front to back in the horizontal plane—of the user's stance center at address;

(c) specific ball positions—front to back in the horizontal plane; and (d) specific, incremental stance widths.

6. The golf swing practice mat of claim 1, wherein said top sheet comprises a semi- to fully-transparent material so that markings placed on its underside show through to a user.

7. The golf swing practice mat of claim 1, wherein said top sheet has one or more shallow dimples formed in its top surface to facilitate the placement of a golf ball thereon.

8. The golf swing practice mat of claim 1, wherein the top surface of said top sheet is smooth, non-porous and suited to the application of a visible substance that registers the path of golf club head passing through the actual or represented hitting area when the club head is in contact with the mat near the bottom-most point in its swing-arc.

9. A golf swing practice mat for placement on an underlying base to aid a golfer in improving his or her swing of a golf club having a club head, said swing comprising a swing-arc having a bottom-most portion thereof, said golf swing practice mat comprising:

(a) a flexible, resilient top sheet that is directly contacted by said club head during said swing and has a substantially smooth, low friction top surface, and a flexural rigidity of 40 pounds per square inch or less; and (b) a means for supporting said top sheet a finite distance above said underlying base and for providing space for said top sheet to yield to and accommodate said bottom-most portion of a reasonably well-aligned golf club swing-arc, such that said mat has an aggregate, total rigidity of 40 pounds per square inch or less.

10. A golf swing practice mat for placement on an underlying base to aid a golfer in improving his or her swing of a golf club having a club head, said swing comprising a swing-arc having a bottom-most portion thereof, said golf swing practice mat comprising:

(a) a low friction, flexible and resilient top sheet that is directly contacted by said club head and has a rigidity of 40 pounds per square inch or less; and (b) a bottom pad for supporting said top sheet a finite distance above said underlying base, and for providing space for said top sheet to yield to and accommodate said bottom-most portion of a reasonably well-aligned swing-arc, said bottom pad being compressible to 50% of its resting height by an applied pressure of 0.0028 Mpa (4 psi) or less.

11. The golf swing practice mat of claim 10, wherein said bottom pad is at least 0.95 cm (0.375 in) thick.

12. The golf swing practice mat of claim 10 wherein said top sheet has a rigidity of 30 pounds per square inch or less.

* * * * *